US008225539B2

(12) United States Patent
Beebe

(10) Patent No.: US 8,225,539 B2
(45) Date of Patent: Jul. 24, 2012

(54) FLOWING WATER DISPLAY

(76) Inventor: Brian Beebe, Detroit, MI (US)

( * ) Notice: Subject to any disclaimer, the term of this patent is extended or adjusted under 35 U.S.C. 154(b) by 0 days.

(21) Appl. No.: 13/086,625

(22) Filed: Apr. 14, 2011

(65) Prior Publication Data

US 2011/0252677 A1 Oct. 20, 2011

Related U.S. Application Data

(60) Provisional application No. 61/324,331, filed on Apr. 15, 2010.

(51) Int. Cl.
*G09F 19/00* (2006.01)

(52) U.S. Cl. ..... 40/406; 40/409; 239/17

(58) Field of Classification Search ..... 40/406, 40/409; 239/17, 18, 20
See application file for complete search history.

(56) References Cited

U.S. PATENT DOCUMENTS 3,211,378 A 10/1965 Zysk
4,747,538 A * 5/1988 Dunn et al. ..... 239/20
5,106,660 A * 4/1992 Vorel ..... 428/13
5,167,368 A * 12/1992 Nash ..... 239/17
5,226,935 A * 7/1993 Wolff et al. ..... 96/262
5,794,318 A * 8/1998 Parker et al. ..... 27/1
6,149,070 A 11/2000 Hones
6,176,027 B1 1/2001 Hlount
6,203,394 B1 * 3/2001 Lee ..... 446/159
6,279,835 B1 * 8/2001 Hansen ..... 239/20
6,311,898 B1 * 11/2001 Gruff ..... 239/17
6,382,520 B1 5/2002 Hones
6,731,429 B2 * 5/2004 Lunde ..... 359/443
7,267,455 B2 * 9/2007 Chernoff et al. ..... 362/253
7,922,103 B2 * 4/2011 Houstoun ..... 239/20

* cited by examiner

*Primary Examiner* — Casandra Davis
(74) *Attorney, Agent, or Firm* — John R. Benefiel

(57) ABSTRACT

A flowing water display including a transparent upright backwall panel covering a graphic art sheet and water sprayed from a spray tube against a forward surface of the panel to cause a down flow of water thereover, with an open topped reservoir tank disposed beneath the panel to collect said water down flow, which is recirculated by a pump drawing water out of the reservoir tank and pumping water back into the spray tube. A pair of removable side channels and top channel frame the graphic art image and conceal the spray tube and plumbing connection to the pump. The components of a wall mounted version allow separate mounting to make a wall mount easier for large size displays.

11 Claims, 6 Drawing Sheets

FLOWING WATER DISPLAY

CROSS REFERENCE TO RELATED APPLICATIONS

This application claims the benefit of U.S. provisional application Ser. No. 61/324,331 filed on Apr. 15, 2010, incorporated by reference herein in its entirety.

BACKGROUND OF THE INVENTION

This invention concerns displays utilizing water flowing down a surface of the display. Such displays have heretofore been proposed and described in U.S. Pat. Nos. 3,211,378; 6,176,027 and 5,167,368. These displays involve pumping water from a reservoir to a distributor spray pipe or weir at the top, where the water is directed to flow down an inclined surface back to the reservoir extending across the width of the surface to collect the water for recirculation.

Such displays typically have a substantial depth since the plumbing for recirculating the water is located behind the display, making wall surface mounting of the display problematic, and table top versions unduly bulky.

Accordingly, these displays are limited in size in order to be able to be wall mounted as a practical matter. It would be advantageous if a flowing water display could be made thinner and less bulky.

It also would be advantageous to enhance the aesthetic appeal of such displays by being able to incorporate graphic artwork into the display, particularly in a way that allow substitution of various images.

It is an object of the present invention to provide a flowing water display of the type described which is of a minimum depth to be more easily wall mounted as well as to be less bulky, while preserving the aesthetic appeal of the display.

It is a further object to provide a flowing water display incorporating graphic art work.

It is yet another object to provide such a display which can be assembled as it is being mounted to enable larger sized flowing water displays to be wall mounted.

SUMMARY OF THE INVENTION

The above recited objects of the invention as well as other objects which will be understood by one skilled in the art upon a reading of the following specification and claims are achieved by a display comprising an open topped elongated reservoir tank at the bottom of the display, preferably of transparent plastic. An immersible pump and optional LED lighting bar may also disposed in the reservoir, although a non-immersible pump could be used, installed in a separate sealed compartment.

A pair of side channel members are removably positioned upright within either end of the reservoir and one of these side channel members encloses a plumbing pipe or tube connected to the pump extending upwardly therethrough.

A transparent backwall panel is mounted upright at the back of the reservoir tank.

In a table top version, the transparent backwall panel has forwardly extending side flanges which have aligned holes formed therein to support a spray tube at the top of the panel extending across and in front of the backwall panel.

In a wall mounted version of a flowing water display according to the invention, the transparent backwall panel is mounted in a sealed frame having a scenic photo or other graphic artwork sheet sealed behind the transparent panel to be viewable therethrough and is separately mounted to a wall surface with a bottom portion thereof extending into the reservoir tank, which tank is itself separately mounted to the wall surface below the sealed frame, such that mounting of the entire display at the same time is not required. This makes wall mounting of large displays more feasible.

A top channel member, preferably formed of an opaque material, is assembled into the display by having either end being press fit to a top of a respective side channel members, the top channel member having a front side wall extending down sufficiently to conceal the spray tube.

A LED down light may be mounted within the top channel, with a power cord therefore routed down through one of the side channels.

In the table top version, a sheet imprinted with a photo or other graphic artwork is removably mounted behind the transparent backwall panel, and able to be viewed since the backwall panel is transparent. This allows other graphic art sheets to be readily mounted or replaced.

The spray tube has a series of spray holes or one or more slot openings formed therein which direct a water flow against the front face of the backwall panel to establish a water flow draining down the forward surface of the backwall channel into the reservoir tank where it is collected for recirculation by the pump.

Both versions can be easily disassembled to allow convenient mounting of the displays.

The photos or other graphic art sheet preferably have water themed images such as scenes of actual waterfalls, ocean views, etc. to enhance the aesthetic appeal of the water flow displays.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
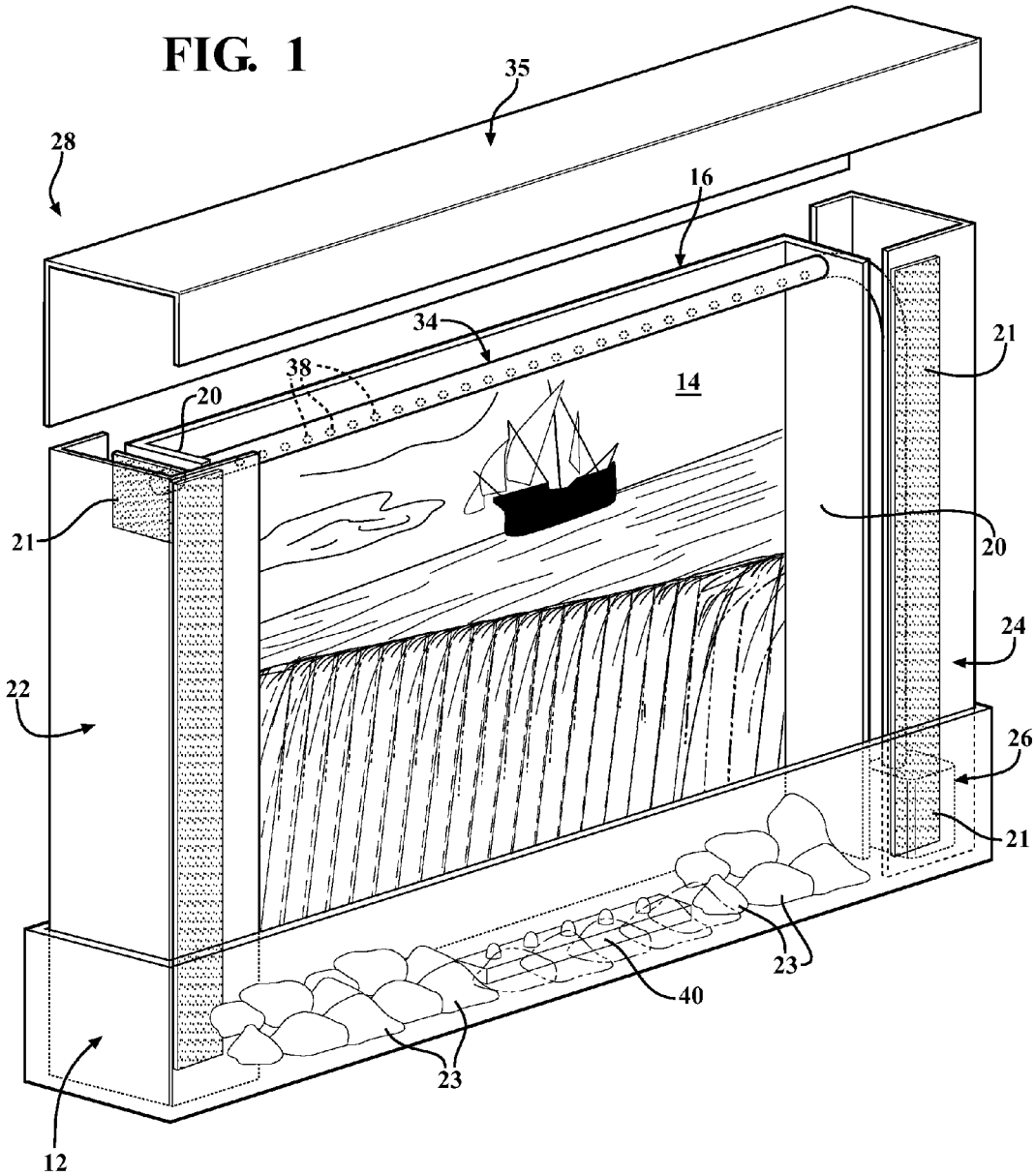
FIG. 1 is a partially exploded pictorial view of a table top embodiment of a flowing water display according to the invention.
Figure 2:
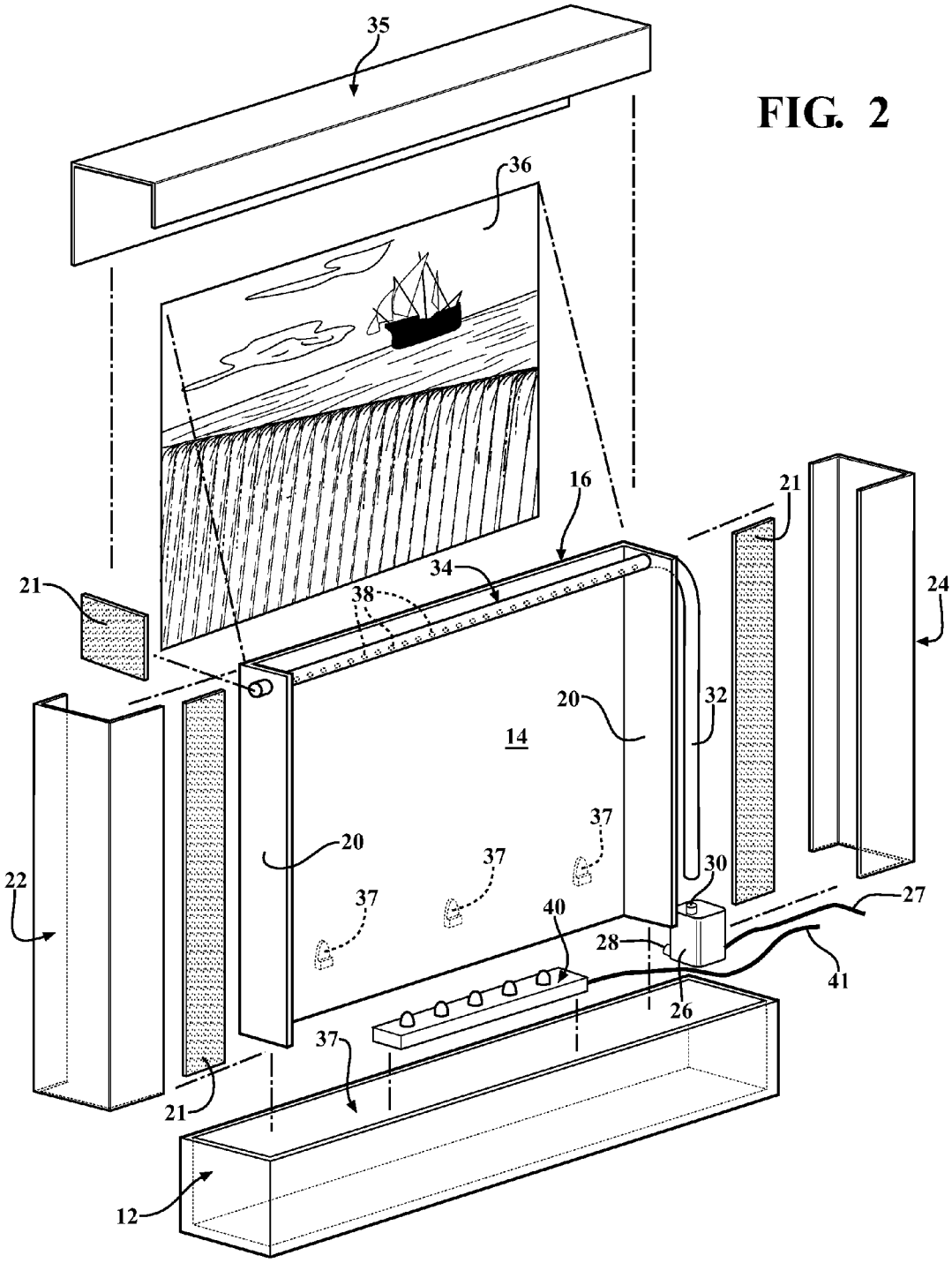
FIG. 2 is a completely exploded pictorial view of the flow water display shown in FIG. 1.

Referring to FIGS. 1 and 2, a flowing water display 10 is shown, comprised of an open topped elongated reservoir 12, which is preferably made of transparent material such as plastic or glass.

The reservoir tank 12 is adapted to receive and hold water collected from a film of water down flow established over the front surface 14 of an upright transparent backwall panel 16 having its lower end centered and disposed in the reservoir tank 12. The backwall panel is secured thereto as by being glued to the tank rear wall. The backwall panel 16 has a pair of forwardly projecting side flanges 20.

A pair of side channel members 22, 24 are stood upright within a respective end of the reservoir tank 12 (which may be pressed fit therein to be held upright), and define respective vertical spaces on either side of the backwall panel 16. The members 22, 24 thus visually define a partial framing of the backwall panel 16.

An immersible electric pump 26 is disposed in the reservoir 12 one end having a bottom inlet 28 able to draw in water collected in the reservoir tank 12. Alternatively, a non-immersible pump can be mounted in a separate chamber.

A pump outlet 30 is connected to a vertical standpipe or tube 32 extending up within the right side channel member 24 and connected to one end of a horizontal spray tube 34 passing through aligned holes in the top of the side flanges 20 of the backwall panel 16 to be supported thereby. The opposite end of the spray tube 34 is plugged.

The side channel members 22, 24 may be opaque to conceal the standpipe 32 or frosted strips and pieces 21 provided to conceal the standpipe 32 and other interior components.

A top channel member 35 is pressed to the upper end of each of the side channel members 22, 24 to be mounted thereto. The top channel member 35 is preferably opaque and colored to be compatible with a scene or image imprinted on a graphic art sheet 36.

The rear walls of channel members 22, 24, 35 may be cut shorter to provide clearance for the flanges 20.

The graphic art sheet 36 (FIGS. 2 and 3) is removably mounted against the rear side of the backwall panel 16 as by providing clips 37 on the lower backside of the reservoir tank 12 or panel 16. The image printed on the sheet 36 is thus visible through the transparent backwall panel 16 while being protected from the flowing water on the front surface 14 created by water flow jets emanating from a series of holes 38 (or slots) in the spray tube 34 and directed against the surface 14.

The holes 38 (or one or more slots) are sized and spaced so as to create an approximately even water down flow across the forward surface 14 of the backwall panel 16 which water descends to flow into the reservoir tank 12 where it is collected for recirculation.

Decorative pebbles 23 (and/or other decorative items) may be placed in the reservoir tank 12 as desired.

An immersible LED light strip 40 (of a type which is commercially available) may be disposed in the bottom of the reservoir tank 12 to illuminate the image on the sheet 36.

Figure 3:
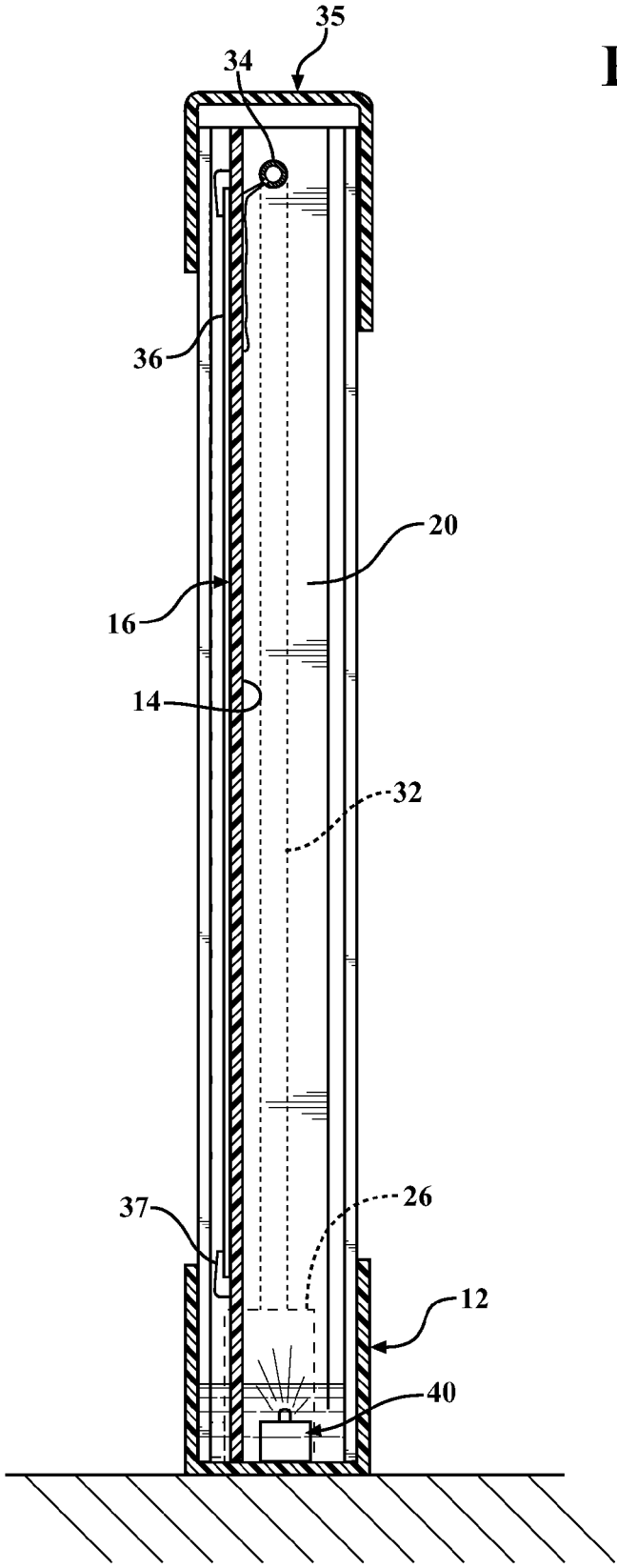
FIG. 3 is a view of a vertical section taken through the flow water display shown in FIGS. 1 and 2.

The reservoir tank 12 can be set on a table top for display as shown in FIG. 3 with the pump and LED light power cords 27, 41 plugged into an electrical outlet.

Figure 4:
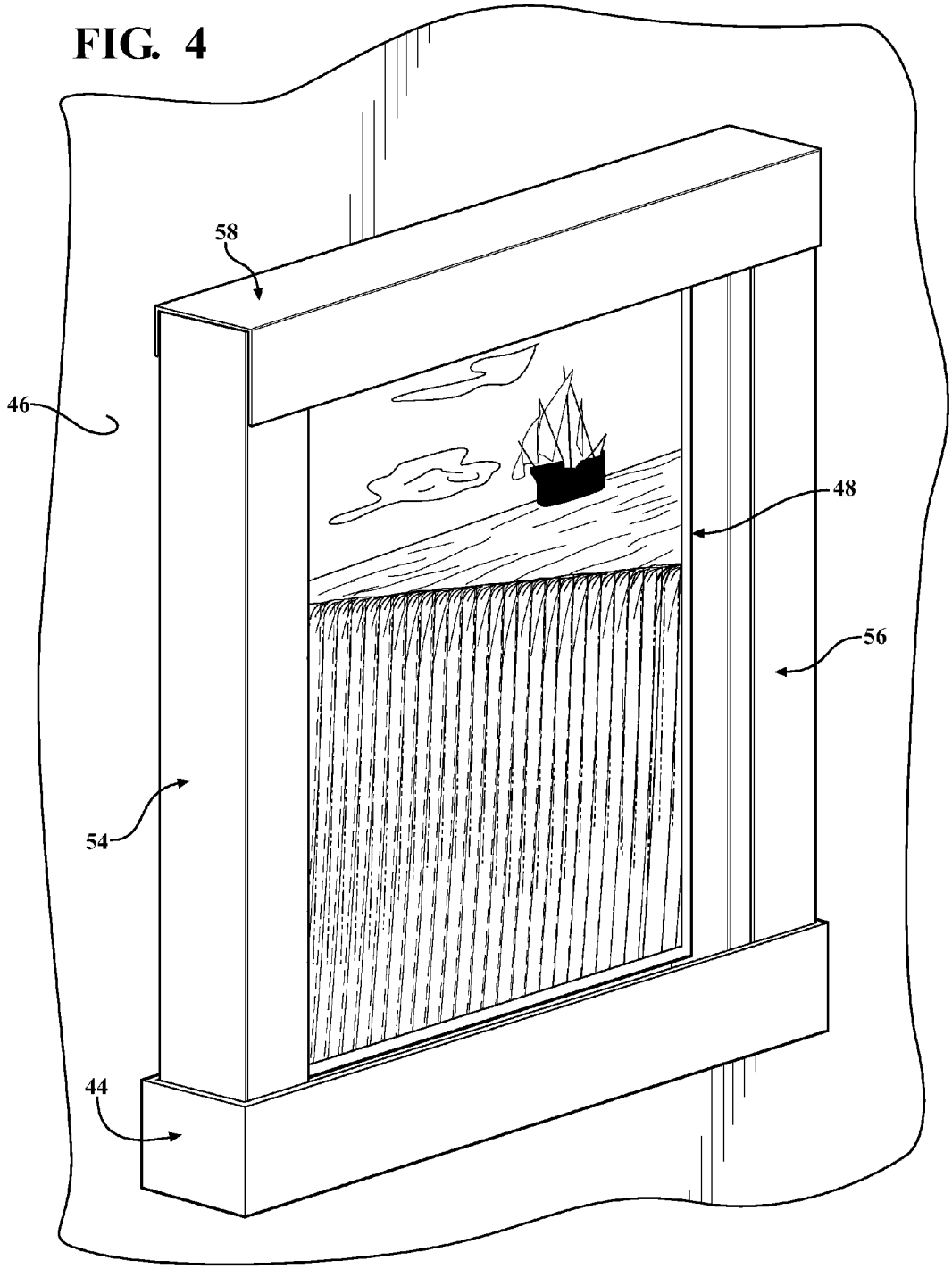
FIG. 4 is a pictorial view of a wall mounted embodiment of a flowing water display according to the invention.
Figure 5:
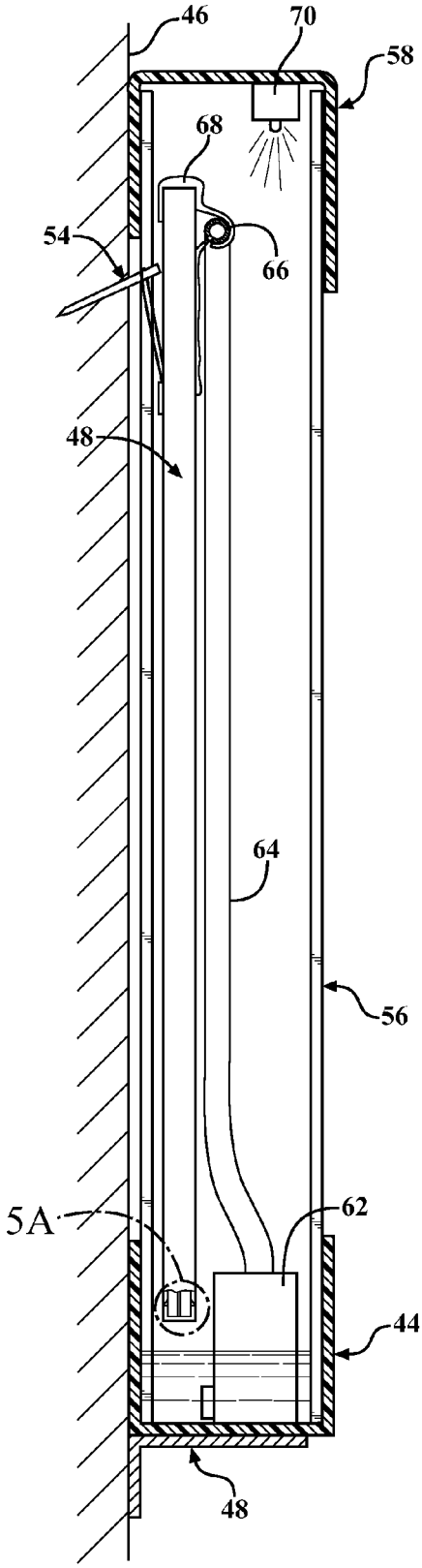
FIG. 5 is a view of a vertical section taken through a wall mounted flow water display according to the invention shown in FIG. 4.
Figure 5A:
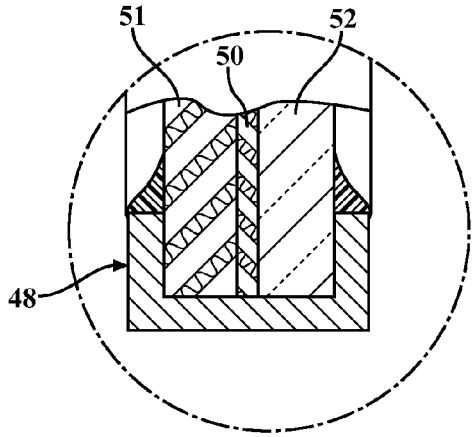
FIG. 5A is an enlarged fragmentary sectional view through the bottom of a sealed frame included in the flow water display shown in FIG. 5.
Figure 6:
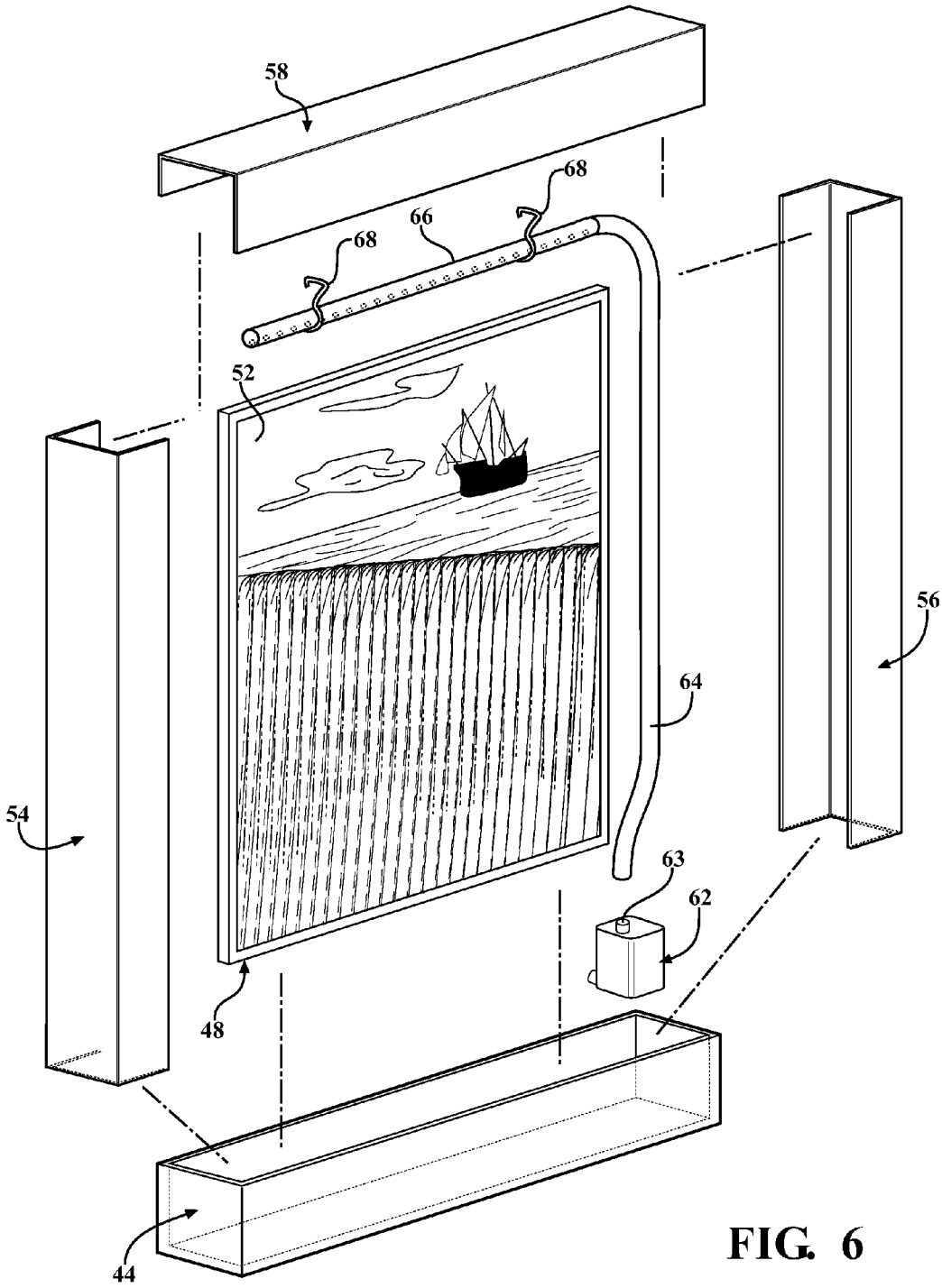
FIG. 6 is an exploded view of the flow water display shown in FIGS. 4 and 5.

Referring to FIGS. 4-6 a larger sized flowing water display 42 according to the invention is shown, designed for wall mounting.

For the wall mounting, parts of the display 42 are designed to be separately installed from each other, and assembled together when mounted to make a wall mounting of larger sized displays much easier to accomplish.

The various separable parts include an open topped elongated reservoir tank 44 which can be mounted to a wall 46 using suitable brackets 45 with screws and anchors (not shown) in the well known manner.

A separate sealed metal frame 48 mounts a transparent plastic or glass cover panel 52 overlaying a decorative art sheet 50 and backing sheet 51, is separately mounted to a wall surface 46 using suitable large anchors 53. The lower end of the frame 48 may be partially disposed within the reservoir 44 (FIG. 5).

A pair of opaque side channel members 54, 56 of a suitable plastic are pressed into the reservoir tank 44, resting upright within a respective end of the reservoir tank 44, with upper ends which are clipped to a respective end of an opaque top channel member 58 as with glued on patches of mateable hook and loop fasteners.

An immersible pump 62 is disposed within one end of the reservoir tank 44 within the lower end of the right side channel member 56, with its outlet 63 connected to a flexible tube 64 extending up within the member 56. A horizontal spray tube 66 is connected to tube 64 at one end, the other end being plugged. The spray tube 66 is supported on the top of the frame 48 by means of clips 68.

A LED light bar 70 can be mounted within the top channel member 58 with power leads (not shown) descending within right channel member 56.

Thus, flowing water displays are provided of shallow depth and separable parts for easy mounting, and which can incorporate selected graphic art sheets for added aesthetic effect.

The invention claimed is:

1. A flowing water display comprising:

a transparent backwall panel;

an open topped elongated reservoir tank adapted to store a volume of water therein and having said transparent backwall panel extending into said reservoir;

a pair of side channel members, each extending up from within a respective end of said reservoir tank;

a spray tube mounted extending cross the top of said transparent backwall panel formed with one or more openings directing a flow of water at a front surface of said transparent backwall panel to create a flowing film of water draining down into said reservoir tank;

a top channel extending between upper ends of said side channels and enclosing said spray tube;

a pump adapted to pump water out of said reservoir and into a standpipe extending up within one of said pair of side channels and connected to one end of said spray tube adjacent said one side channel; and a graphic art sheet having an image imprinted thereon mounted to the rear of said transparent backwall panel whereby said film of water flows over said image.

2. The flowing water display according to claim 1 wherein said graphic art sheet is mounted to be readily removable and replaceable with another graphic art sheet.

3. The flowing water display according to claim 1 wherein said transparent backwall panel forms a part of a mounting frame for said graphic art sheet comprising a paper sheet, said frame being sealed to prevent the entrance of water therein to prevent wetting of said graphic art sheet.

4. The flowing water display according to claim 3 wherein said sealed frame has wall mounting anchors on a back side thereof and wherein said reservoir has separate wall supports attachable to said wall.

5. The flowing water display according to claim 1 wherein said side and top channels are all opaque to conceal said standpipe and said spray tube.

6. The flowing water display according to claim 1 further including a waterproof light bar mounted within said top channel.

7. The flowing water display according to claim 1 wherein said pair of side channel members are readily detachable from said reservoir tank and said top channel is readily detachable from said side channel members.

8. The flowing water display according to claim 7 wherein said transparent backwall panel is removable from said reservoir tank.

9. The flowing water display according to claim 8 wherein said spray tube is readily detachable from said transparent backwall panel.

10. The flowing water display according to claim 1 wherein said spray tube extends through aligned holes in inner side flanges of said backwall panel to be supported thereby.

11. The flowing water display according to claim 1 wherein said reservoir tank is constructed of transparent plastic.

* * * * *